US006234887B1

(12) United States Patent
Hundebøl

(10) Patent No.: US 6,234,887 B1
(45) Date of Patent: May 22, 2001

(54) METHOD FOR SANDING SURFACES ON ITEMS

(75) Inventor: Keld Otting Hundebøl, Ansager (DK)

(73) Assignee: HH Patent A/S, Ansager (DK)

( * ) Notice: Subject to any disclaimer, the term of this patent is extended or adjusted under 35 U.S.C. 154(b) by 0 days.

(21) Appl. No.: 09/529,509

(22) PCT Filed: Oct. 30, 1998

(86) PCT No.: PCT/DK98/00472

§ 371 Date: Apr. 14, 2000

§ 102(e) Date: Apr. 14, 2000

(87) PCT Pub. No.: WO99/22905

PCT Pub. Date: May 14, 1999

(30) Foreign Application Priority Data

Nov. 3, 1997 (DK) ..... 1997 01245

(51) Int. Cl.[7] ..... B24B 23/00; B24B 27/08

(52) U.S. Cl. ..... 451/358; 451/359

(58) Field of Search ..... 451/178, 184, 451/211, 28, 336, 359, 358, 344, 541, 271

(56) References Cited

U.S. PATENT DOCUMENTS

| | | |
|---|---|---|
| 4,646,473 | 3/1987 | Hundebol . |
| 5,131,292 | 7/1992 | Hundebol . |
| 5,274,962 | 1/1994 | Hundebol . |
| 5,291,689 | 3/1994 | Hundebol . |
| 5,441,440 | 8/1995 | Hundebol . |
| 5,601,481 | 2/1997 | Hundebol . |

FOREIGN PATENT DOCUMENTS

| | | |
|---|---|---|
| 156703 | 9/1989 | (DK) . |
| 165549 | 12/1992 | (DK) . |
| 93 00243 Y6 | 12/1993 | (DK) . |
| 0 320 558 | 12/1987 | (EP) . |
| 0 458 724 A1 | 5/1991 | (EP) . |
| 0 471 641 A2 | 8/1991 | (EP) . |
| 2141648 | 1/1985 | (GB) . |
| WO 91/17867 | 11/1991 | (WO) . |
| WO 94/27781 | 12/1994 | (WO) . |
| WO 98/05472 | 2/1998 | (WO) . |

*Primary Examiner*—Derris H. Banks
(74) *Attorney, Agent, or Firm*—William J. Sapone; Coleman Sudol Sapone, PC

(57) ABSTRACT

With sanding or sanding machines with rotating sanding tools comprising sanding segments which are rotated in mutually opposite directions, according to the invention a more uniform sanding result and uniform wear on the tools is achieved with a method whereby the tools (10) which are rotated in the direction like a roller are rotated in the direction like a roller are rotated slightly faster than are the tools (1) which are rotated in the opposite direction. The necessary increase in speed has shown to be around 7%, since the individual segments under the increased influence of the centrifugal force will thus obtain the same sanding pressure and herewith a uniform sanding effect for all of the sanding tools regardless of their direction of rotation to thee item.

2 Claims, 2 Drawing Sheets

METHOD FOR SANDING SURFACES ON ITEMS

PRIOR ART TECHNIQUE

Figure 1:
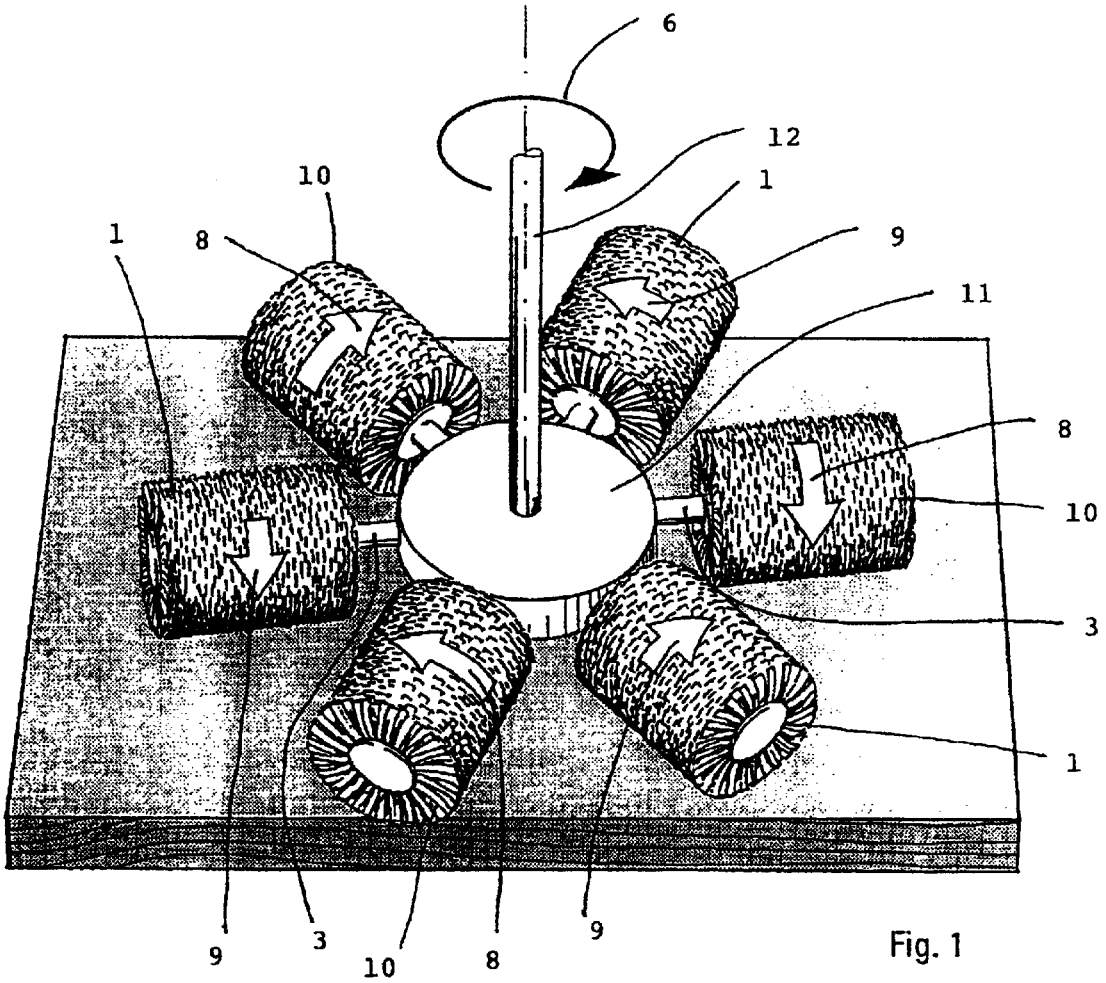

The invention concerns a method for the sanding of surfaces on items by means of tools which consist of sanding segments which extend radially from a core in the formation of a cylindrical sanding tool, said tool being rotated around an axis of rotation which extends substantially parallel with the surface on the item, so that under the influence of centrifugal force the individual sanding segments exert a sanding pressure against the surface of the item, and where there are mounted several of such tools which are rotated in mutually opposite directions while at the same time being moved in relation to the item, or where the item is moved in relation to the sanding tools.

The sanding of surfaces by means of such tools is used especially for the processing of wooden items whose surfaces must be smooth.

Similarly, in connection with lacquered surfaces, the sanding can be used with advantage as intermediate sanding between lacquer applications.

Moreover, the method can be used for the cleaning of metal surfaces, where the sanding also serves to deburr the edges so that both an effective and uniform deburring is achieved.

Finally, the method can be used for items of plastic where, for example, the surface must be ground with the object of removing fraze and/or for subsequent surface treatment.

Machines are known for the execution of such a method. For example, from the description of DK Patent 156.703, a machine is known for the sanding of wooden items, and which is provided with six sanding rollers in a tool which rotates in such a manner that adjacent rollers are rotated in opposite directions during the turning of the tool over the item.

The individual rollers are rotated at the same speed, i.e. the rollers which rotate clockwise and the rollers which rotate counter-clockwise during the turning of the tool over the item all rotate at the same speed.

However, there hereby arises a small difference in the sanding effect of the individual sanding elements, the reason being that because of the differences in the relative speeds, the individual sanding segments will have different contact pressure, sanding pressure, against the surface of the item.

The sanding elements on the tools rotating in the manner like a roller will namely be fed a little slower over the item, and herewith have a relatively lower sanding effect than the corresponding sanding elements on the tools which rotate in the opposite direction, in that the relative sanding speed of these is higher and the sanding effect therefore greater than that of the tools which rotate like a roller.

This difference in effect results not only in a non-uniform sanding of the surface, but also a non-uniform wear on the sanding elements.

From DK 9300243 Y6 there is known a pass-through sanding machine with sanding tools which have variable speeds of rotation. The object of this is to be able to mount sanding tools successively with different sanding aggressiveness, in that the speed of the individual tools can be set in accordance with their aggressiveness.

THE OBJECT OF THE INVENTION

It is the object of the invention to remedy the disadvantages and drawbacks of the known methods, and this is achieved according to the invention when the sanding tool which moves in the rolling direction over the item is rotated more quickly than the tool which moves in the opposite direction over the item is rotated.

According to the invention, by simply rotating the tools which rotate in the direction like a roller faster than the tools which are rotated in the opposite direction, there can hereby be achieved a completely uniform sanding effect by all of the sanding segments regardless of their direction of rotation.

In a surprisingly simple manner, there is hereby achieved a completely perfect sanding result, completely without any variation in the sanding by the individual sanding tools, and with a completely uniform wear on the sanding elements as a result.

Moreover, a uniform physical loading of the item on the belt is achieved, in that there will be uniform side effects on the item from both the tools which rotate like a roller and those which rotate in the opposite direction.

To this can be added that in step with the wear, the speed of rotation of the sanding tools can gradually be increased to compensate for the reduced sanding effect while avoiding the hitherto-known simultaneous increase in non-uniformity in the sanding, which occurs particularly due to the increased heating-up of the sanding tools which rotate in the opposite direction. This is especially important for the sanding of metal plate, where variations in temperature will give rise to tensions and deformations in the metal plate.

As disclosed in claim 2, by letting the tools which rotate in the direction like a roller rotate 13% faster than the tools rotating in the opposite direction, theoretically a completely uniform sanding pressure is achieved for both types of sanding tools, but since the centrifugal force plays a role at the relatively high speeds of rotation, an increase of only 7% in the speed of the tools rotating in the rolling direction has shown to provide the most uniform sanding result, and herewith a correspondingly uniform wear on the sanding elements.

Due to the progressiveness of the centrifugal force, the increase in rotation of 7% will correspond to the theoretical compensation of 13% for achieving a uniform sanding force or sanding pressure.

THE DRAWING

Figure 2:
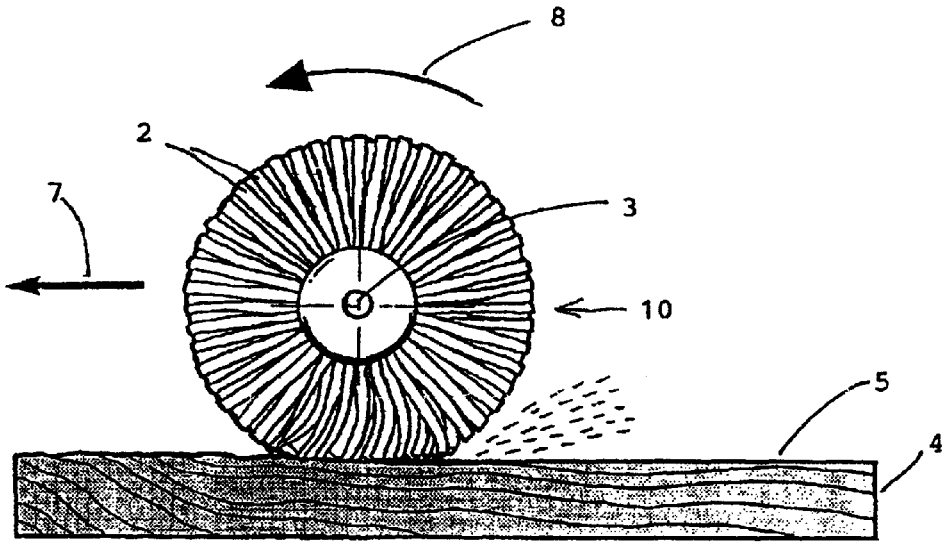
Figure 3:
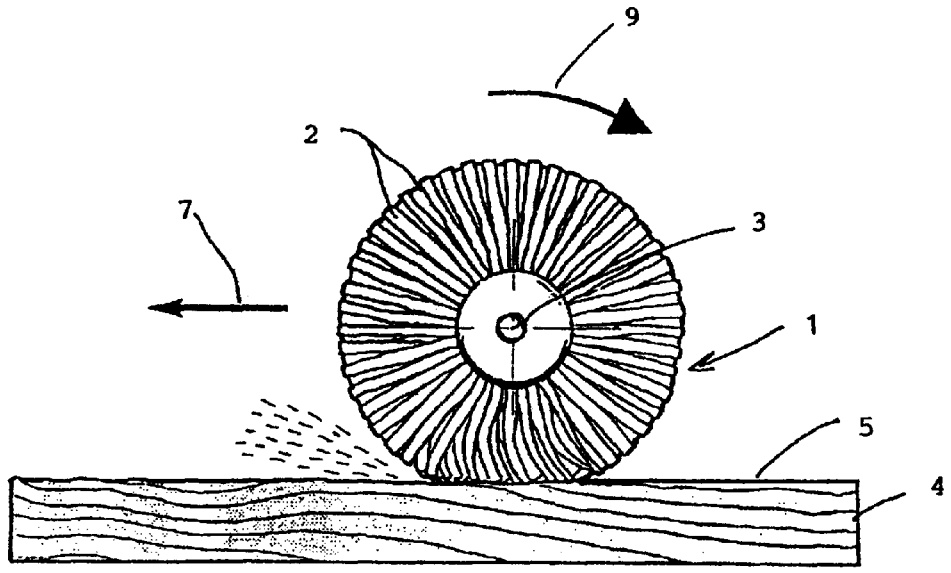

The invention will be described in more detail in the following section with reference to the drawing, where FIG. 1 is a perspective view of a sanding tool during operation, FIG. 2 shows a sanding tool rotating in the direction like a roller seen from the outside, and FIG. 3 shows a sanding tool rotating in the opposite direction, similarly seen from the outside, both during operation.

DESCRIPTION OF THE METHOD

In FIG. 1 there is shown an example of a sanding tool which partly comprises three cylindrical sanding tools 10 which are rotated counter-clockwise seen from the outside end, and as shown in FIG. 2, and partly three sanding tools 1 which are rotated clockwise seen from the outside end, and as shown in FIG. 3.

The sanding tools can consist of disks cut from sheet material and which are provided with incisions extending radially outwards for the formation of segmented sanding elements 2. The individual sanding disks are provided with a hole around the centre axis so that they can be mounted on an axle 3 by being pushed on to said axle and tightened to form a sanding tool 1, 10

The six rotation axles 3 are housed in a drive 11 mounted on a turning shaft 12 which can turn the drive 11, and therewith the tools 1, 10, around over the item 4 in a turning movement which extends parallel to the surface of the item.

When the tools 1, 10 are thus turned, as indicated by the arrow 6, the individual axles 3 with the tools 1, 10 are rotated so that the three tools 10 are rotated in the direction like a roller, as indicated by the arrow 8, while the remaining tools 1 are rotated in the opposite direction, as indicated by the arrow 9.

During the sanding, the individual tools 1, 10 are rotated on their axles 3 while at the same time they are turned over the item 4 by the shaft 12 in a turning movement 6.

In order for the whole of the item to be swept by the tools, it can be moved in relation to the tools, e.g. on a not-shown transport plane, or the tools can be moved over the item. Alternatively, this can be effected by a combination of movements, i.e. where both the item and the tools are moved in relation to one another.

In order to achieve a perfect sanding result, according to the invention the three tools 10 rotating in the rolling direction must be rotated slightly faster than the three tools 1 rotating in the opposite direction. This is indicated in the drawing by means of arrows 8 and 9, the length of which indicates the difference in the speed of rotation.

An example of such a sanding tool can have an outer tool diameter of 300 mm, a speed of rotation of 1,000 rpm in the oppositely directed rotation, and a speed of rotation of 1,070 rpm in the rolling direction, i.e. a 7% increase in speed in relation to the speed in the opposite direction.

The theoretical difference between the relative speeds of the tools in the rolling direction and the opposite direction over the item is 13%, but because of the increased influence of the centrifugal force on the sanding segments during the increase in speed, it is thus only necessary to increase the speed of rotation by 7%. There is thus hereby achieved the same relative sanding speed and herewith sanding pressure over the item for all of the segments on the tools.

The difference is shown in FIGS. 2 and 3, and it is seen that the tool 10 rotating in the rolling direction rotates slightly faster than the tool 1 rotating in the opposite direction, whereby this resulting sanding effect becomes uniform due to the uniform sanding movements of the individual sanding elements.

There is hereby achieved a uniform sanding result, in that at no time will there be any variation on the surface 5 of the item 4.

Further to this improvement in the sanding result, a uniform wear on the sanding elements 2 will also be achieved, the reason being that these are now loaded to the same degree by the uniform sanding effect. The lifetime of the tools thus becomes the same for all of the tools, and the changing of the sanding disks on all of the tools can therefore be effected at the same time.

It is naturally an advantage that the sanding tools can be replaced at the same time, and not when only half of them are worn down.

Since the load on the items is more uniform, the securing effect on the conveyor can be reduced to the average load, whereby the consumption of power by the vacuum conveyor can be considerably reduced.

Moreover, the uniform wear on the sanding elements will enable the sanding effect to be adjusted, which will result in a uniform result, and will not like the known methods give rise to an increased sanding effect for the tools rotating in the opposite direction with a subsequent non-uniform heating-up.

The method is described in connection with a sanding tool as shown in FIG. 1, but the same method can be executed with sanding machines of other constructions, merely providing that they comprise tools which are rotated in different directions. It is thus possible for the sanding result for all such sanding tools to be improved by changing the speed at which their tools are rotated.

What is claimed is:

1. Method for sanding a surface on at least one item comprising using sanding tools in a form of a cylindrical sanding tool which consists of sanding segments extending radially from a core, rotating each sanding tool around an axis of rotation which extends substantially parallel with the surface on the item, so that under an influence of a centrifugal force, the sanding segments exert a sanding pressure against the item surface, and mounting the sanding tools which are rotated in mutually opposite directions while at the same time being moved in relation to the item, or the item is moved in relation to the sanding tools, wherein a first sanding tool (10), which is moved (7) while rotating in one direction over the item (4), is rotated faster (8) than is a second sanding tool (1) which is moved (7) while rotating in an opposite direction (9) over the item (4).

2. Method according to claim 1, wherein to compensate for a difference in sanding pressure, a speed of rotation (8) of the first sanding tool (10) is at a maximum 13% and preferably 7% higher than a speed of rotation (9) for the second sanding tool (1) rotating in the opposite direction.

* * * * *